US005155091A

United States Patent [19]

Nakayama et al.

[11] Patent Number: 5,155,091

[45] Date of Patent: Oct. 13, 1992

[54] HEAT-SENSITIVE TRANSFER RECORDING MATERIAL

[75] Inventors: Noritaka Nakayama; Osamu Ishige, both of Hino, Japan

[73] Assignee: Konica Corporation, Tokyo, Japan

[21] Appl. No.: 727,063

[22] Filed: Jul. 8, 1991

[30] Foreign Application Priority Data

Jul. 16, 1990 [JP] Japan ..... 1-188472

[51] Int. Cl.[5] ..... B41M 5/035; B41M 5/26

[52] U.S. Cl. ..... 503/227; 428/195; 428/336; 428/341; 428/342; 428/412; 428/474.4; 428/480; 428/913; 428/914

[58] Field of Search ..... 8/471; 428/195, 336, 428/341, 342, 412, 474.4, 480, 913, 914; 503/227

[56] References Cited

U.S. PATENT DOCUMENTS 4,880,769 11/1989 Dix et al. ..... 503/227

4,892,858 1/1990 Nakamine et al. ..... 503/227

*Primary Examiner*—B. Hamilton Hess

*Attorney, Agent, or Firm*—Frishauf, Holtz, Goodman & Woodward

[57] ABSTRACT

Disclosed is a heat-sensitive transfer recording material comprising a support and a heat-sensitive layer thereon, wherein said layer contains at least a compound represented by the formula (I):

(I)

(wherein $R^1$ represents hydrogen atom, an alkyl group, an aryl group or a —CO-$R^4$— (where $R^4$ represents an alkylene group) which has carbonyl carbon to nitrogen atom and also is bonded at one end to the benzene nucleus substituted with $R^2$ to form a ring; $R^2$ and $R^3$ each represent hydrogen atom, a halogen atom, an alkyl group, a cycloalkyl group, an aryl group, an alkenyl group, an aralkyl group, an alkoxy group, an aryloxy group, a cyano group, an acylamino group, an alkylthio group, an arylthio group, a sulfonylamino group, a ureido group, a carbamoyl group, a sulfamoyl group, an alkoxycarbonyl group, an aryloxycarbonyl group, a sulfonyl group, an acyl group, an amino group; $R^1$, $R^2$ and $R^3$ may be also the same or different from each other; m and n represent integers of 1 to 3; and X represents a hydroxyl group or a substituted or unsubstituted amino group).

22 Claims, 8 Drawing Sheets

1

2

3

4

5

6

7

8

9

10

11

12

13

14

15

16

17

18

19

20

21

22

23

24

25

26

27

28

29

30

31

32

33

34

35

36

37

38

HEAT-SENSITIVE TRANSFER RECORDING MATERIAL

BACKGROUND OF THE INVENTION

This invention relates to a heat-sensitive transfer recording material, more particularly to a novel heat-sensitive transfer recording material containing a magenta dye having excellent spectral characteristic and excellent heat-resistance characteristic.

In the prior art, as the method for obtaining a color hard copy, investigations have been made about color recording techniques by ink jet, electrophotography, heat-sensitive transfer, etc.

Among these, the heat-sensitive transfer system has such advantages as easy operation and maintenance, possibility of miniaturization of the apparatus, reduction of cost, or inexpensive running cost, etc.

The heat-sensitive transfer recording system includes two types of systems. One is the system in which the transfer sheet having a heat-meltable ink layer on a support is heated by a heat-sensitive head to have the above ink transferred by melting onto a transferable sheet, and the other is the thermal diffusion transfer system (including the sublimation transfer system) in which a transfer sheet having an ink layer containing a thermally diffusible dye (including sublimable dye) on a support is heated by a heat-sensitive head to transfer the above thermally diffusible dye onto a transferable sheet.

Of these, the thermal diffusion transfer system is more advantageous for full color recording, because the tone of image can be controlled by varying the amount of the dye transferred depending on the change in thermal energy of the heat-sensitive head.

Whereas, in the heat-sensitive transfer recording of the thermal diffusion transfer system, the dye to be used in the heat-sensitive transfer material is important, and affects greatly the speed of transfer recording, the image quality, the storage stability of image, etc.

Therefore, the dye to be used in the thermal diffusion system as described above is required to be endowed with the properties as mentioned below:

(1) It can be thermally diffused (sublimated) with ease under the heat-sensitive recording conditions (temperature of head, heating time of head);

(2) It should have a preferable hue in color production;

(3) It should not be pyrolyzed at the heating temperature during recording;

(4) It should have good light resistance, heat resistance, humidity resistance and chemical resistance;

(5) It should have a large coefficient of molar light absorption;

(6) It can be easily added to the heat-sensitive transfer material;

(7) It can be easily synthesized;

(8) Further, in addition to these, excellent fixability of image has been demanded.

In the present invention, thermal diffusion refers to diffusion and/or transfer substantially with the dye alone under gas, liquid or solid state depending on the heating energy during heating of the heat-sensitive transfer material, which has substantially the same meaning as the so called "sublimation transfer".

In the prior art, as the magenta dye for heat-sensitive transfer material, there have been disclosed anthraquinone type dyes, azo dyes, azomethine type dyes, etc. in Japanese Unexamined Patent Publications Nos. 79896/1984, 30392/1985, 30394/1985, 253595/1985, 262190/1986, 5992/1988, 205288/1988, 1591/1989, 63194/1989, etc, However, no dye satisfying all of the above-mentioned conditions has not yet been found, and particularly it has been desired to develop a magenta dye in thermal diffusibility, hue, heat resistance, light resistance and a heat-sensitive transfer material by use of said dye.

The present invention has been accomplished on the basis of the state of the art as described above.

Accordingly, the present inventors have made various studies about the dye for heat-sensitive transfer material from the standpoint as described above, and consequently found that the compound of the formula (I) satisfies the conditions mentioned above, and is particularly preferable with excellent hue, to accomplish the present invention on the basis of such finding.

SUMMARY OF THE INVENTION

An object of the present invention is to provide a heat-sensitive transfer material by use of a magenta dye improved in thermal diffusibility, heat resistance, hue and an image forming method by use of said dye.

The heat-sensitive transfer recording material of the present invention for solving the above-mentioned task is a heat-sensitive transfer recording material comprising a support and a heat-sensitive layer thereon, wherein said layer contains at least a compound represented by the formula [I]:

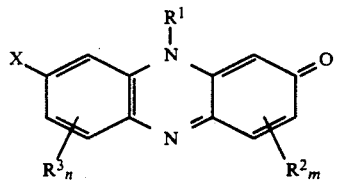

(I)

[wherein $R^1$ represents hydrogen atom, an alkyl group, an aryl group or a —CO—$R^4$— (where $R^4$ represents an alkylene group) which has carbonyl carbon to nitrogen atom and also is bonded at one end to the benzene nucleus substituted with $R^2$ to form a ring; $R^2$ and $R^3$ each represent hydrogen atom, a halogen atom, an alkyl group, a cycloalkyl group, an aryl group, an alkenyl group, an aralkyl group, an alkoxy group, an aryloxy group, a cyano group, an acylamino group, an alkylthio group, an arylthio group, a sulfonylamino group, a ureido group, a carbamoyl group, a sulfamoyl group, an alkoxycarbonyl group, an aryloxycarbonyl group, a sulfonyl group, an acyl group, an amino group; $R^1$, $R^2$ and $R^3$ may be also the same or different from each other; m and n represent integers of 1 to 3; and X represents a hydroxyl group or a substituted or unsubstituted amino group].

DESCRIPTION OF THE INVENTION

Figure 1:
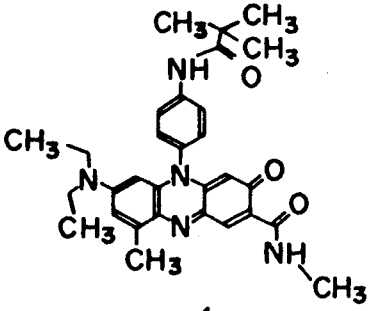
FIGS. 1 to 38 show representative examples of the compound represented by the formula (I) to be used in the present invention.
Figure 2:
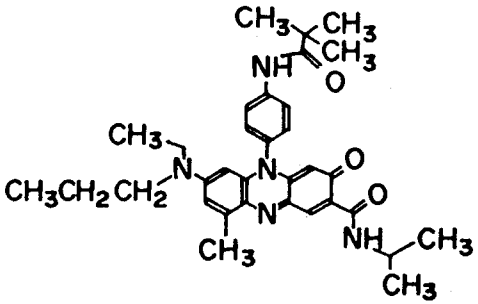

The heat-sensitive transfer recording material of the present invention has at least a heat-sensitive layer containing the compound represented by the formula (I) as described below on a support.

In the above formula [I], when the group represented by $R^1$ is an alkyl group, it may also have a substituent and may be either straight chain or branched. Specific examples may include methyl, ethyl, isopropyl, n-butyl, 2-ethylhexyl, cyclopentyl, cyclohexyl, benzyl, 2-methoxyethyl, 2-acetoxyethyl groups. Preferable alkyl groups may include those having 1 to 8 carbon atoms, particularly 1 to 4 carbon atoms, more preferably methyl and ethyl groups.

Then the group represented by $R^1$ is an aryl group, a phenyl group is preferable, and this phenyl group may also has various kinds of substituents. The substituents on this phenyl group are not particularly limited, and may include halogen atoms, amide group, sulfonamide group, alkoxy group, aryloxy group, carbamoyl group, sulfamoyl group, sulfonyl group, etc.

When the group represented by $R^1$ is —CO—$R^4$— which has carbonyl carbon to nitrogen atom and also is bonded at one end to the benzene nucleus substituted with $R^2$ to form a ring, $R^4$ can include alkylene groups having 1 to 4 carbon atoms which may have substituents such as alkyl groups, etc.

When the group represented by $R^1$ is hydrogen atom, the formula (I) includes not only the formula (Ia) shown below, but also (IB) which is the tautomeric isomer thereof.

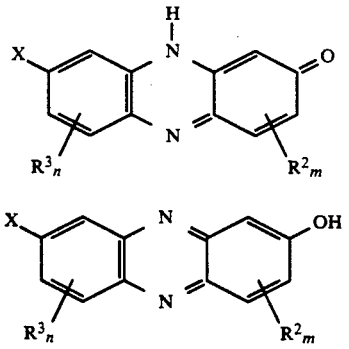

(Ia)

(Ib)

Next, as the group represented by $R^2$, there may be included hydrogen atom, halogen atoms (e.g. fluorine atom, chlorine atom, bromine atom, etc.), alkyl groups (e.g. methyl, ethyl, isopropyl, n-butyl groups), cycloalkyl groups (e.g. cyclopentyl, cyclohexyl groups), aryl groups (e.g. phenyl group), alkenyl groups (e.g. 2-propenyl group), aralkyl groups (e.g. benzyl, 2-phenethyl groups), alkoxy groups (e.g. methoxy, ethoxy, isopropoxy, n-butoxy groups), aryloxy groups (e.g. phenoxy group), cyano group, acylamino groups (e.g. acetylamino, propionylamino groups), alkylthio groups (e.g. methylthio, ethylthio, n-butylthio groups), arylthio groups (e.g. phenylthio group), sulfonylamino groups (e.g. methanesulfonylamino, benzenesulfonylamino groups), ureido groups (e.g. 3-methylureido, 3,3-dimethylureido, 1,3-dimethylureido groups), sulfamoylamino groups (e.g. dimethylsulfamoylamino group), carbamoyl groups (e.g. methylcarbamoyl, ethylcarbamoyl, dimethylcarbamoyl groups), sulfamoyl groups (e.g. ethylsulfamoyl, dimethylsulfamoyl groups), alkoxycarbonyl groups (e.g. methocycarbonyl, ethoxycarbonyl groups), aryloxycarbnyl groups (e.g. phenoxycarbonyl group), sulfonyl groups (e.g. methanesulfonyl, butanesulfonyl, phenylsulfonyl groups), acyl groups (e.g. acetyl, propanoyl, butyroyl groups), amino groups (e.g. methylamino, ethylamino, dimethylamino groups), imide groups (e.g. phthalimide group), heterocyclic groups (e.g. benzimidazolyl, benzthiazolyl, benzoxazolyl groups).

These groups may be further substituted, and examples of the substituent may include alkyl groups (e.g. methyl, ethyl, trifluoromethyl groups), aryl groups (e.g. phenyl group), alkoxy groups (e.g. methoxy, ethoxy groups), amino groups (e.g. methylamino, ethylamino groups), acylamino groups (e.g. acetylamino group), sulfonyl groups (e.g. methanesulfonyl group), alkoxycarbonyl groups (e.g. methoxycarbonyl group), cyano group, nitro group, halogen atoms (e.g. chlorine, fluorine atoms) and so on.

The groups represented by R2, when having substituents, should preferably have not more than 12 carbon atoms as the total including the carbon number of the substituents, particularly preferably not more than 8.

Of the substituents represented by $R^2$, more preferable are acylamino, ureido, sulfonylamino, carbamoyl, sulfamoyl, imide, heterocyclic groups.

Next, as the group represented by $R^3$, the groups represented by the above R2 can be included, but preferably alkyl, alkoxy groups, halogen atoms and acylamino groups.

R1, R2 and R3 may be respectively the same or different from each other.

Next, as the substituent on the substituted amino group represented by X, there may be included alkyl groups (e.g. methyl, ethyl, n-butyl, 2-hydroxyethyl, 2-methanesulfonamidoethyl groups), tetrahydroxyfuryl group, and an alkylene group with one end bonded to the benzene nucleus substituted with $R^3$.

Preferable substituents can include alkyl groups having not more than 8 carbon atoms, particularly 1 to 3 carbon atoms, 2-tetrahydroxyfuryl group, and propylene group with one end bonded to the benzene ring substituted with $R^3$.

Next, representative examples of the compound represented by the formula (I) are shown in FIGS. 1 to 38.

The compounds represented by the formula (I) to be used in the present invention are not limited to these at all.

These compounds represented by the formula (I) to be used in the present invention are magenta dyes for heat-sensitive transfer recording material improved in thermal diffusibility, heat resistance and hue.

The compound represented by the formula (I) to be used in the present invention (hereinafter sometimes referred to as the dye compound to be used in the present invention) can be obtained according to, for example, the known synthetic method such as the oxidation coupling reaction between a phenol derivative with a p-phenylenediamine derivative or a p-aminophenol derivative. The coupling reaction should preferably be permitted to proceed under basic conditions, and the reaction medium may be either an organic solvent, an aqueous organic solvent or an aqueous solution. As the oxidation agent, any one having a potential capable of oxidizing the p-phenylenediamine derivative or the p-aminophenol derivative may be used, regardless of whether it may be organic or inorganic. For example, various inorganic oxidation agents such as silver halide, hydrogen peroxide, manganese dioxide, potassium persulfate, oxygen or various oxidation agents such as N-bromosuccinimide, chloroamine T, etc. can be used. Also, by choosing appropriate current, voltage, supporting electrolyte, solvent and electrodes, etc, it can be also synthesized according to the electrode reaction.

Thus, the dye compound to be used in the present invention which is the dye for heat-sensitive transfer recording material can be obtained.

The heat-sensitive transfer recording material of the present invention is constituted by forming a heat-sensitive layer containing the compound to be used in the present invention as described above on a support.

The above-mentioned heat-sensitive layer to be used in the heat-sensitive transfer recording material comprising the dye compound to be used in the present invention in a binder resin.

The amount of the dye compound of the present invention in the heat-sensitive layer may be 0.1 to 20 g, preferably 0.2 to 10 g, per 1 $m^2$ of the support.

Examples of the above binder can include water-soluble polymers such as the cellulose type, the polyacrylic acid type, the polyvinyl alcohol type, the polyvinyl pyrrolidone type, etc., polymers soluble in organic solvents such as acrylic resin, methacrylic resin, polystyrene, polycarbonate, polysulfone, polyether sulfone, polyvinyl butyral, polyvinyl acetal, nitro cellulose, ethyl cellulose, etc.

The amount of the above binder to be used in the heat-sensitive layer may be 0.1 to 50 g, preferably 0.2 to 30 g per 1 $m^2$ of the support.

The above-mentioned heat-sensitive layer can be obtained by dissolving or dispersing in fine particles one or two or more kinds of the above dye compound into a solvent together with the binder to prepare a coating material for formation of heat-sensitive layer containing the dye of the present invention, followed by coating, drying of the coating material for formation of heat-sensitive layer on a support.

When a polymer soluble in organic solvent is used as the binder, it may be used not only as a solution dissolved in organic solvent but may also used in the form of a latex dispersion.

Examples of the solvent for preparation of the heat-sensitive layer may include water, alcohols (e.g. ethanol, propanol), cellosolves (e.g. methylcellosolve), esters (e.g. ethyl acetate), aromatics (e.g. toluene, xylene, chlorobenzene), ketones (e.g. acetone, methyl ethyl ketone), chlorine type solvent (e.g. chloroform, trichloroethylene) and so on.

The dye ink thus obtained is coated on a support by use of bar coater, roll coater, reverse roll coater, knife coater, rod coater, air doctor coater, screen printing, gravure printing, etc.

The thickness of the heat-sensitive layer may be 0.1 to 5 μm, preferably 0.2 to 3 μm, as dry film thickness.

As the support to be used in the present invention, any material which has good dimensional stability and can stand the heat during recording at the head may be employed, and tissue paper such as condenser paper, glassine paper, heat-resistant plastic film such as polyethylene terephthalate, polyamide, polycarbonate can be employed.

The thickness of the support may be preferably 2 to 30 μm, preferably 3 to 20 μm.

The support may also have a subbing layer for the purpose of improving adhesiveness with the binder or preventing transfer, dyeing of the dye onto the support side.

Further, the support may also have a slipping layer on the back (opposite side to the ink layer) for the purpose of sticking of the head to the support.

The heat-sensitive transfer recording material of the present invention has basically a structure having a heat-sensitive layer comprising the dye compound of the present invention and a binder provided on a support. However, it may also have a thermally fusible layer containing a thermally fusible compound as disclosed in Japanese Unexamined Patent Publication No. 106,997/1984 on the above-mentioned heat-sensitive layer.

As the thermally fusible compound, a colorless or white compound having a melting point of 65° to 130° C. may be preferably used, including waxes such as carunauba wax, beeswax, canderilla wax or the like, higher fatty acids such as stearic acid, behenic acid or the like, alcohols such as xylytol or the like, amides such as acetamide, benzamide or the like, ureas such as phenylurea, diethylurea or the like.

In the thermally fusible layer, for enhancing retentivity of the dye, for example, a polymer such as polyvinyl pyrrolidone, polyvinyl butyral, saturated polyester, etc. may be also contained.

The heat-sensitive transfer recording material of the present invention can obtain a magenta dye image from one kind of dye, but when applied to full-color recording, it is preferable that the total three layers of the cyan colorant layer containing a cyan dye, the magenta colorant layer containing a magenta dye and the yellow colorant layer containing a yellow dye should be coated successively repeatedly on the same surface of the support.

If necessary, the total four layers including a heat-sensitive layer containing a black image forming substance in addition to a yellow heat-sensitive layer, a magenta heat-sensitive layer containing the dye according to the present invention may be also coated successively repeatedly on the same surface of the support.

Thus, the heat-sensitive transfer recording material of the present invention can be obtained by forming the heat-sensitive layer containing the dye of the present invention on the support.

By use of the heat-sensitive transfer recording material of the present invention, an image can be formed in the following manner.

Figure 39:
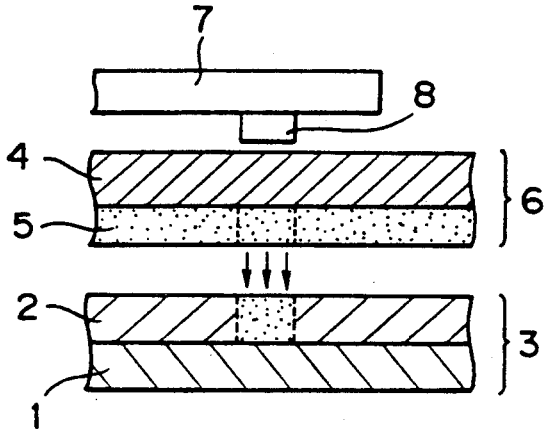
FIG. 39 illustrates the action of forming an image on an image-receiving material by use of the heat-transfer recording material which is an embodiment of the present invention.

That is, as shown in FIG. 39, when the image-receiving material 3 having the image-receiving substrate 1 and the image-receiving layer 2 is used and the heat-transfer recording material 6 comprises the support 4 and the heat-sensitive layer 5, the above dye in the heat-sensitive layer 5 is diffusion migrated to the image-receiving material 3 by the heat supplied from the heat-generating resistor 8 to form an image with the above dye compound in its image-receiving layer 2.

The above-mentioned image-receiving substrate can be formed generally of paper, plastic film or paper-plastic film composite. The image-receiving layer can be formed of a polymer layer comprising one or two or more kinds of polyester resin, polyvinyl chloride resin, copolymer resin of vinyl chloride with other monomers (e.g. vinyl acetate, etc.), polyvinyl butyral, polyvinyl pyrrolidone, polycarbonate, etc.

In the image-receiving layer, a basic compound and/or a mordant should be preferably contained.

The above-mentioned basic compound is not particularly limited, but inorganic or organic basic compounds may be employed, such as calcium carbonate, sodium carbonate, sodium acetate, alkylamine, etc.

As the above-mentioned mordant, compounds having tertiary amino group, compounds having nitrogen containing heterocyclic group and compounds having quaternary cationic groups of these may be included.

Figure 40:
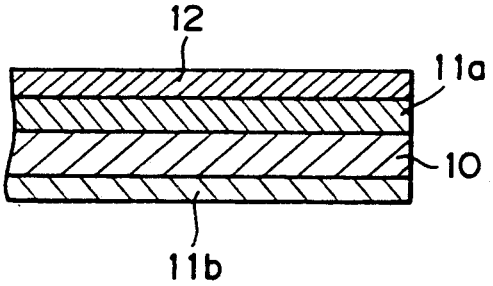
FIG. 40 illustrates an example of the image-receiving material.

An example of preferable image-receiving material is shown in FIG. 40. As shown in FIG. 40, the image-receiving material has a constitution comprising polyethylene layers 11*a*, 11*b* laminated on the both surfaces of the paper 10, and further the polyvinyl chloride layer 12 which is the image-receiving layer laminated on the polyethylene layer 11*a* on one side thereof.

On the other hand, as another embodiment of the heat-sensitive transfer recording material, when the heat-sensitive transfer recording medium comprises a thermally fusible layer 9 provided on the surface of the heat-sensitive layer 5 provided on a support, the above dye compound contained in the heat-sensitive layer 5 generates heat is diffusion migrated to the thermally fusible layer 9 by, for example, the heat from the heat-generating resistor of the thermal head, and subsequently the thermally fusible substance 9*a* is containing the dye compound is migrated to the image-receiving material 3 through agglomeration destruction or interface peel-off.

Figure 41:
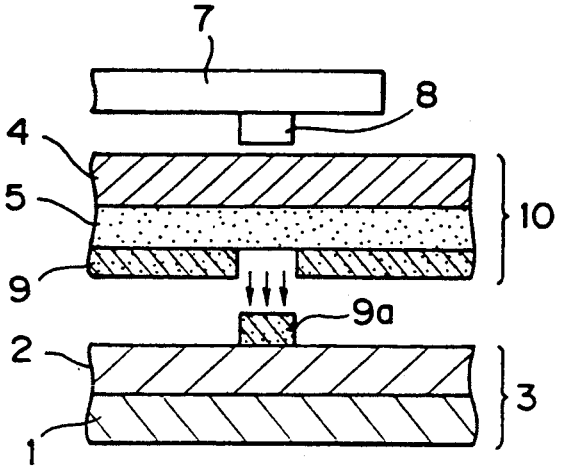
FIG. 41 illustrates the action of forming an image on an image-receiving material by use of the heat-transfer recording material which is another embodiment of the present invention.

When the heat-sensitive transfer recording material shown in FIG. 41 is used, the image-receiving material is not particularly limited, provided that it is a material which can retain the thermally fusible layer peeled off. It may be also the image-receiving material to be used for the heat-sensitive transfer recording material (an example is shown in FIG. 1) having a heat-sensitive layer on the support, or alternatively it may be also constituted only of the image-receiving substrate.

Also, in the heat-sensitive transfer recording material shown in FIG. 41, the thermally fusible layer should preferably contain a basic compound and/or a mordant.

The present invention is now described in more detail by referring to Examples.

EXAMPLE 1

Preparation of Compound 1:

To a solution of 5 g of a phenol derivative [A] of which structure formula is shown blow dissolved in 100 ml of ethyl acetate was added 100 ml of water containing 12 g of p-diethylaminoaniline sulfate and 150 g of potassium carbonate dissolved therein, and the mixture was vigorously stirred.

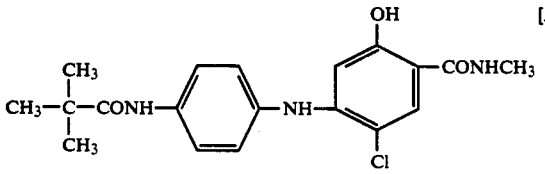

Into the mixture was added dropwise a solution of 18.4 g of red prussiate dissolved in 200 ml of water. The mixture was stirred at room temperature for one hour, and dil. hydrochloric acid was added, followed further by stirring for 30 minutes. The organic layer was separated and washed with 100 ml of water. After concentration under reduced pressure, the residue was purified by a silica gel column (eluant:ethyl acetate:hexane = 1:1) to obtain 3.2 g of the desired product.

By NMR and Mass spectrum, the product was confirmed to be the structure shown in FIG. 1.

Preparation of coating material for formation of heat-sensitive layer:

A mixture of the following composition was treated with a paint conditioner to obtain a coating material for formation of heat-sensitive layer which is a uniform solution containing the thermally diffusible dye.

| | |
|---|---|
| Compound 1 | 10 g |
| Polyvinyl butyral resin | 15 g |
| Methyl ethyl ketone | 150 ml |
| Toluene | 150 ml |

Preparation of transfer sheet:

The coating material for formation of heat-sensitive layer containing the above-mentioned thermally diffusible dye of the present invention was coated and dried on a support 1 comprising a polyimide film with a thickness of 15 μm to a coated amount after drying of 1.0 g/m2 by means of a wire bar to form a heat-sensitive layer containing the thermally diffusible dye of the present invention to prepare the heat-sensitive transfer recording material - 1.

Transfer recording:

The heat-sensitive transfer recording material - 1 and the recording medium were superposed so that the heat-sensitive layer and the recording medium opposed to each other, and image recording was performed by use of heat-sensitive head. As the result, a magenta image with gradation was obtained.

The maximum density of the image obtained is shown in Table 1.

As the recording medium (image-receiving material), a cast coated paper coated with polyvinyl chloride (attached H amount 5 g/m$^2$) was employed.

The recording conditions are as follows:

| | |
|---|---|
| Density of main scanning, sub-scanning | 4 dots/mm |
| Recording power | 0.8 W/dot |
| Heating time of head | 20 m. sec |
| heating time controlled stepwise between (applied energy about 11.2 × 10 − 3J) at intervals of 2 m sec (application energy about 1.12 × 10 − 3J) | |

In Table 1, one with sharpness of the image being unchanged after the sample obtained was stored at 50° C., and also without color change even when the surface rubbed with white paper was rated as 0, while one slightly color changed as Δ, and one with white paper being colored as x.

EXAMPLE 2-6

Figure 3:
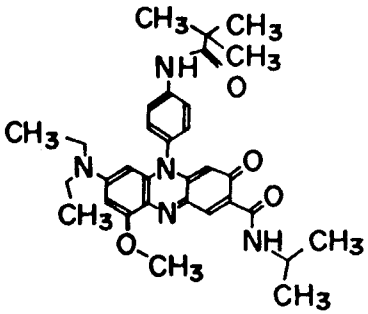
Figure 4:
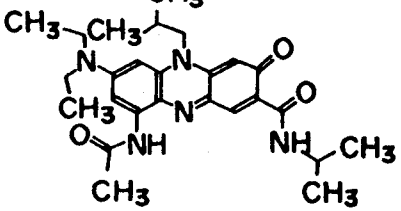
Figure 5:
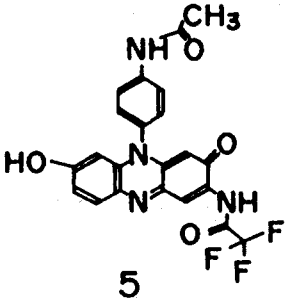
Figure 6:
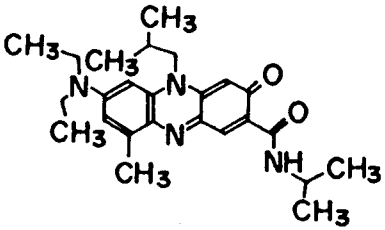
Figure 7:
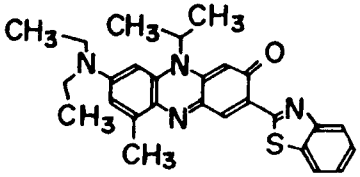
Figure 8:
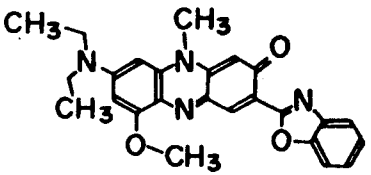
Figure 9:
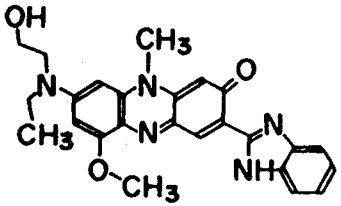
Figure 10:
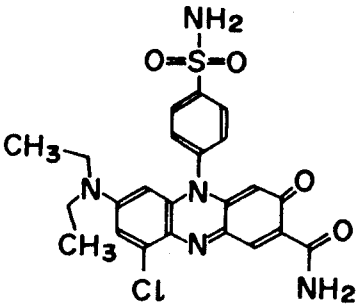
Figure 11:
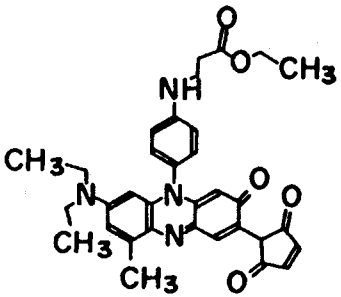
Figure 12:
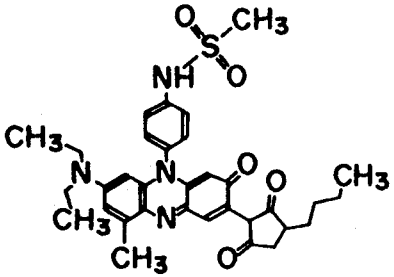
Figure 13:
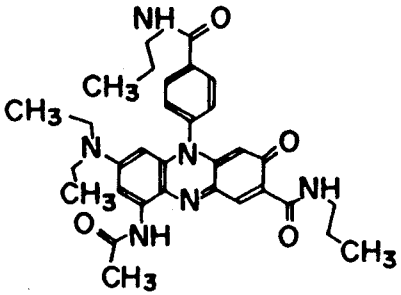
Figure 14:
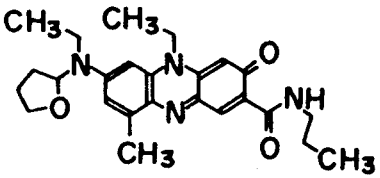
Figure 15:
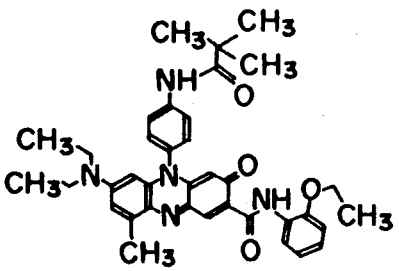
Figure 16:
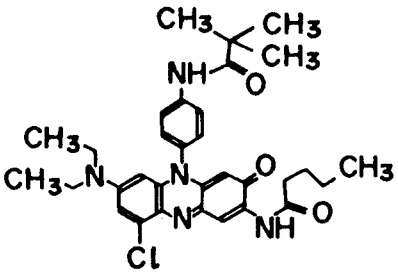
Figure 17:
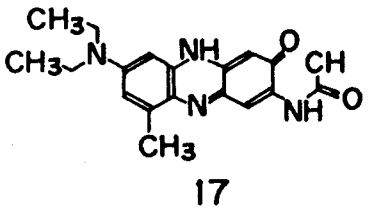
Figure 18:
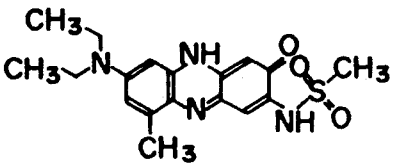
Figure 19:
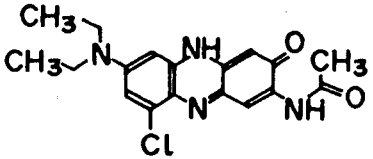
Figure 20:
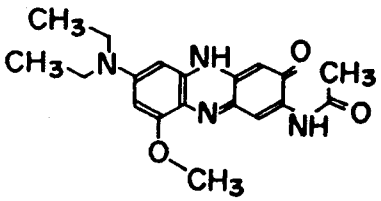
Figure 21:
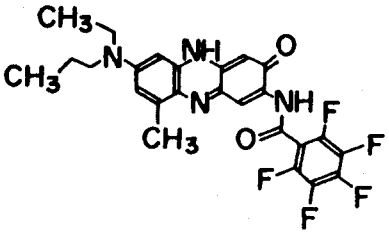
Figure 22:
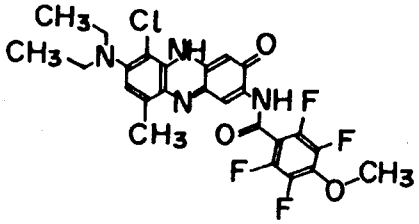
Figure 23:
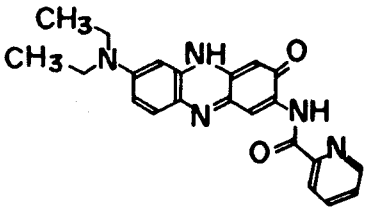
Figure 24:
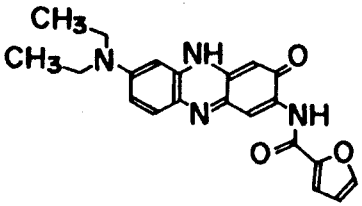
Figure 25:
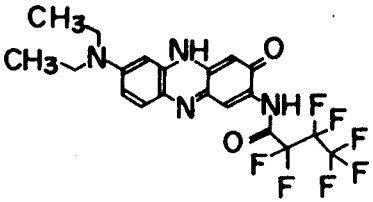
Figure 26:
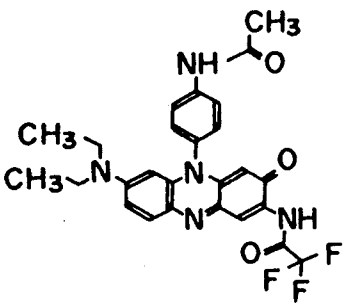
Figure 27:
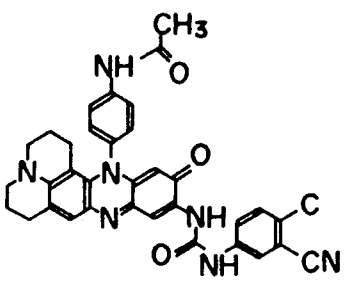
Figure 28:
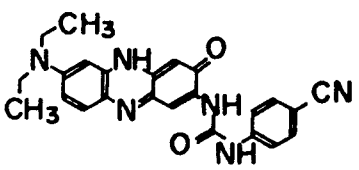
Figure 29:
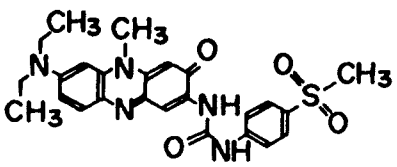
Figure 30:
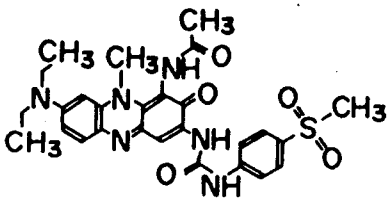
Figure 31:
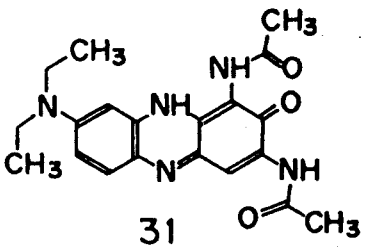
Figure 32:
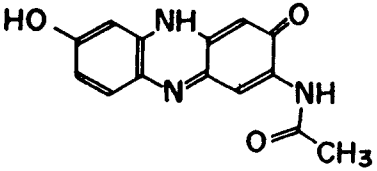
Figure 33:
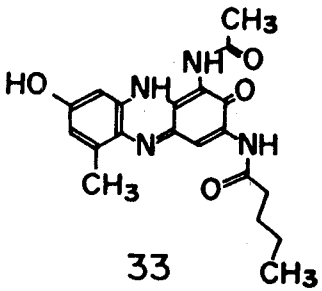
Figure 34:
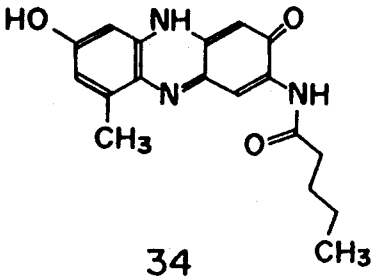
Figure 35:
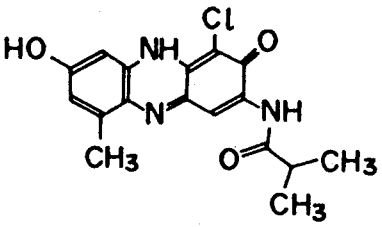
Figure 36:
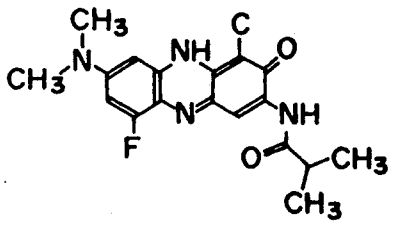
Figure 37:
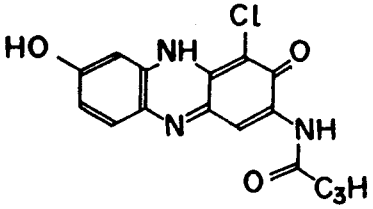
Figure 38:
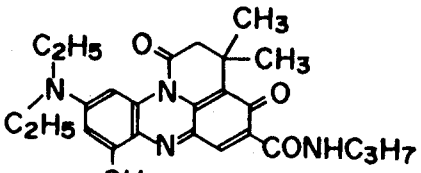

In Example 1, in place of the compound of the heat-sensitive transfer recording material - 1, the dye compound with the structure shown in FIG. 3, the dye compound with the structure shown in FIG. 6, the dye compound with the structure shown in FIG. 17, the dye compound with the structure shown in FIG. 21, and the dye compound with the structure shown in FIG. 36 were used, following otherwise the same procedure as in Example 1, heat-sensitive transfer recording materials were obtained.

The results are shown in Table 1.

COMPARATIVE EXAMPLE 1 AND 2

In Example 1, heat-sensitive transfer recording materials were obtained in the same manner except for using the comparative dyes M-1 and M-2 shown below in place of Compound 1 in the heat-sensitive transfer recording material - 1.

M-1

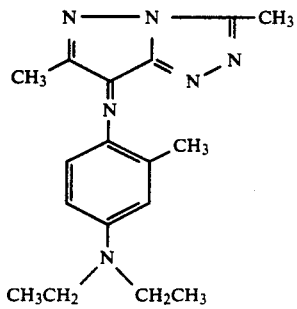

M-2

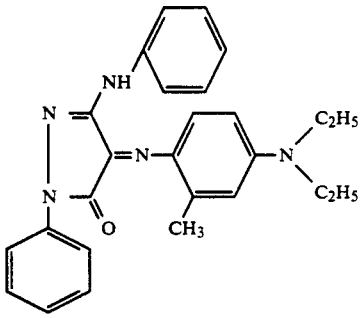

The results are shown in Table 1.

TABLE 1

| | Dye | Color formation density *1 | Fastness |
|---|---|---|---|
| Example 1 | 1 | 2.51 | ○ |
| Example 2 | 3 | 2.43 | ○ |
| Example 3 | 6 | 2.32 | ○ |
| Example 4 | 17 | 2.46 | ○ |
| Example 5 | 21 | 2.41 | ○ |
| Example 6 | 36 | 2.39 | ○ |
| Comparative example 1 | M-1 | 1.49 | Δ |
| Comparative example 2 | M-2 | 1.37 | X |

*1 Measured by use of optical densitometer (Konica Kabushiki Kaisha, PCA-65 type)

Evaluation:

From Table 1, it can be understood that Examples 1 to 6 which are samples of the present inventions are all high in color formation density, and also excellent in fastness.

Also, it can be understood that Examples 1 to 6 are very high in chroma in the hue of magenta as compared with Comparative examples 1, 2 to be advantageous in color reproduction.

The heat-sensitive transfer recording material of the present invention has excellent spectral characteristics, excellent heat resistance, and enables gradation expression by use of a magenta dye improved in thermal diffusibility, hue, heat resistance, light resistance.

What is claimed is:

1. A heat-sensitive transfer recording material comprising a support and a heat-sensitive layer thereon, wherein said layer contains a compound represented by the formula (I):

(I)

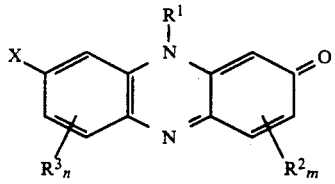

wherein $R^1$ represents hydrogen atom, and alkyl group, an aryl group or a —CO—$R^4$ where $R^4$ represents an alkylene group which is bonded at one end to the benzene nucleus substituted with $R^2$ to form a ring; $R^2$ and $R^3$ each represent hydrogen atom, a halogen atom an alkyl group, a cycloalkyl group, an aryl group, an alkenyl group, an aralkyl group, an alkoxy group, an aryloxy group, a cyano group, an acylamino group, an alkylthio group, an arylthio group, a sulfonylamino group, a ureido group, a carbamoyl group, a sulfamoyl group, an alkoxycarbonyl group, an aryloxycarbonyl group, a sulfonyl group, an acyl group, an amino group; $R^1$, $R^2$ *pl and R3* may be also the same or different from each other; m and n represent integers of 1 to 3; and X represent a hydroxyl group or a substituted or unsubstituted amino group.

2. The recording material of claim 1 wherein $R^1$ of the formula (I) is an alkyl group.

3. The recording material of claim 1 wherein $R^1$ of the formula (I) is an alkyl group having 1 to 8 carbon atoms.

4. The recording material of claim 1 wherein $R^1$ of the formula (I) is an alkyl group having 1 to 4 carbon atoms.

5. The recording material of claim 1 wherein $R^1$ of the formula (I) is a phenyl group.

6. The recording material of claim 1 wherein $R^1$ of the formula (I) is a hydrogen atom.

7. The recording material of claim 6 wherein the compound represented by the formula (I) is the compound represented by the formulae (Ia) or (Ib):

(Ia)

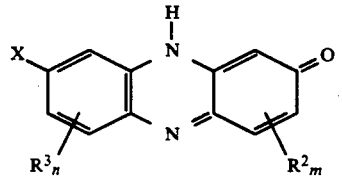

(Ib)

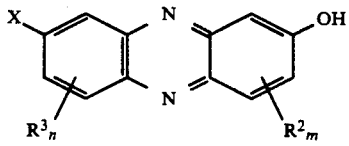

wherein $R^2$, $R^3$, m, n and X have the same meanings as in claim 1.

8. The recording material of claim 1 wherein $R^2$ of the formula (I) is at least one selected from the group consisting of an acylamino group, an ureido group, a sulfonylamino group, a carbamoyl group, a sulfamoyl group, an imide group and a heterocyclic ring group.

9. The recording material of claim 1 wherein $R^3$ of the formula (I) is at least one selected from the group consisting of an alkyl group, an alkoxy group, a halogen atom and an acylamino group.

10. The recording material of claim 1 wherein the heat-sensitive layer is the compound of the formula (I) dispersed into a binder resin.

11. The recording material of claim 10 wherein the binder resin is at least one selected from the group consisting of a cellulose polymer, a polyacrylic acid polymer, a polyvinyl alcohol polymer, a polyvinyl pyrrolidone polymer, acrylic resin, methacrylic resin, polystyrene, polycarbonate, polysulfone, polyether sulfone, polyvinyl butyral and polyvinyl acetal.

12. The recording material of claim 11 wherein the binder is present in an amount of 0.1 to 50 g per 1 $m^2$ of the support.

13. The recording material of claim 12 wherein the binder is present in an amount of 0.2 to 30 g per 1 $m^2$ of the support.

14. The recording material of claim 10 wherein the binder resin is at least one selected from the group consisting of nitro cellulose and ethyl cellulose.

15. The recording material of claim 1 wherein the compound of the formula (I) is present in an amount of 0.1 to 20 g per 1 $m^2$ of the support.

16. The recording material of claim 15 wherein said compound of formula (I) is selected from the group consisting of compounds 1-38 as follows:

1

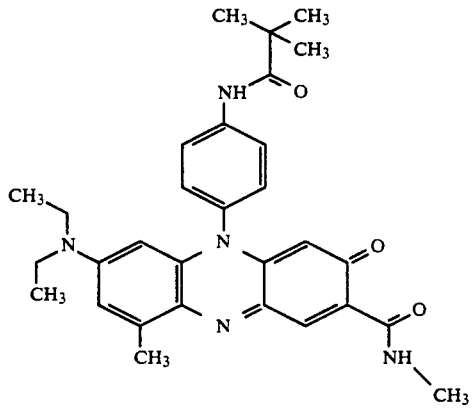

2

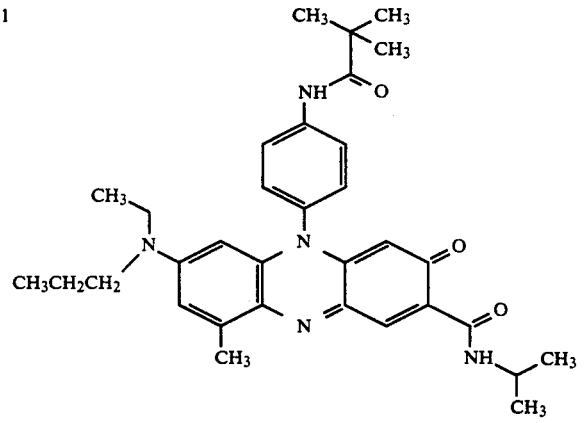

3

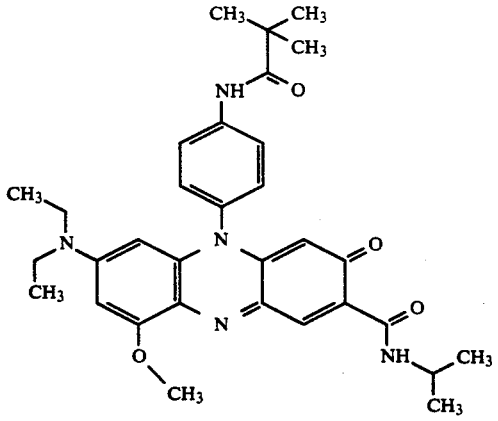

4

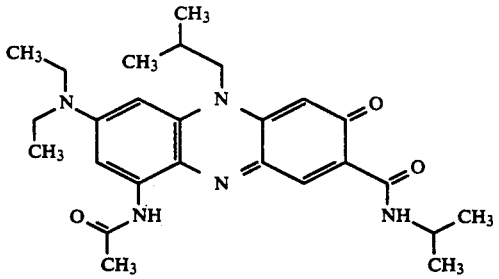

5

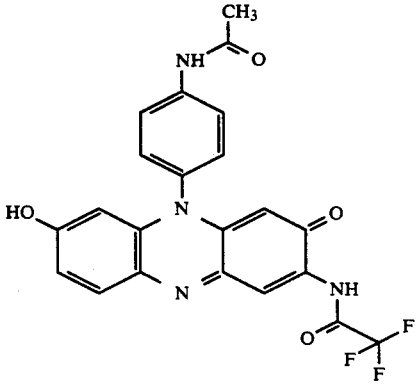

6

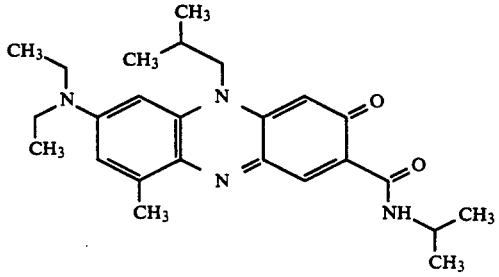

-continued
7
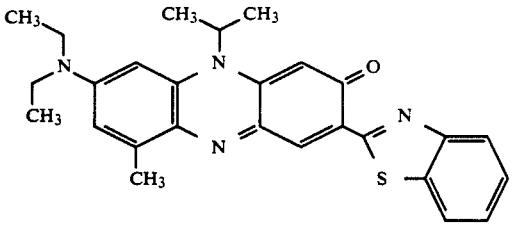
8
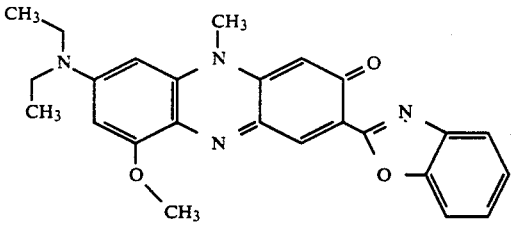
9
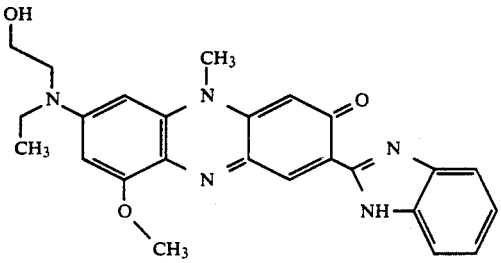
10
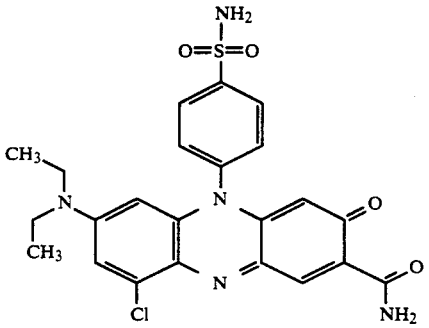
11
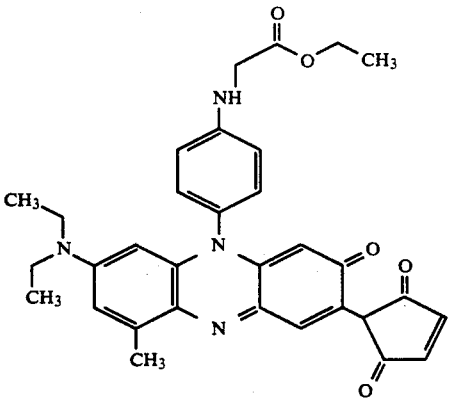
12
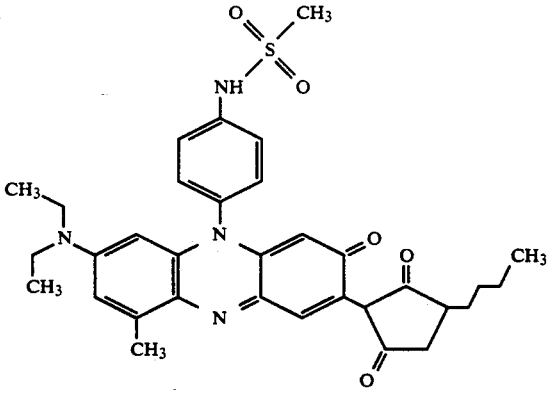
13
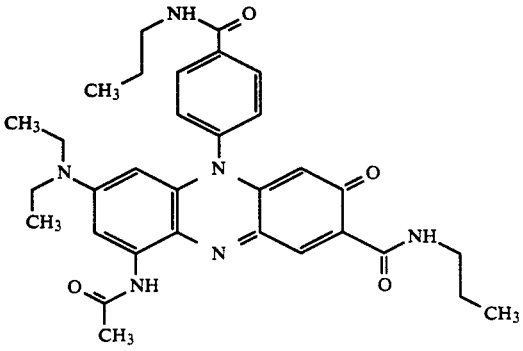
14
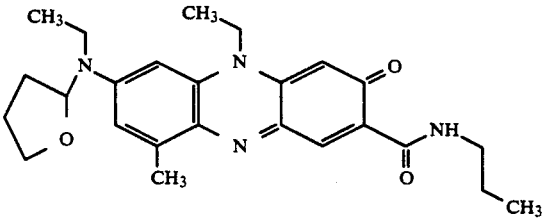

-continued
15
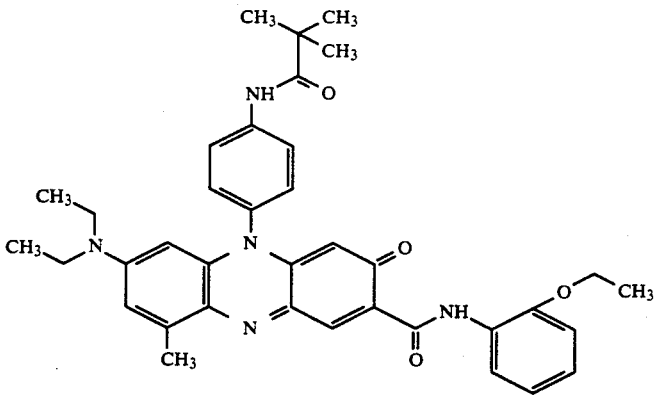
16
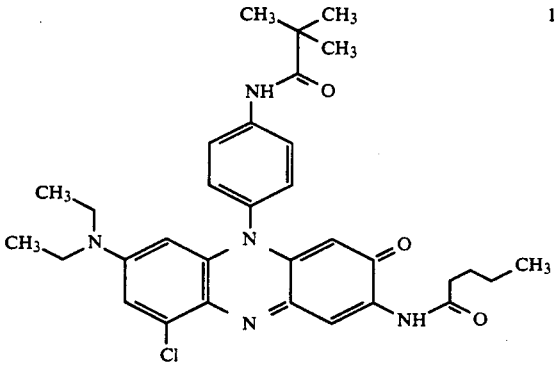
17
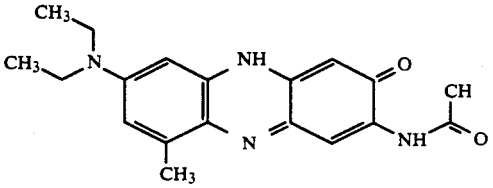
18
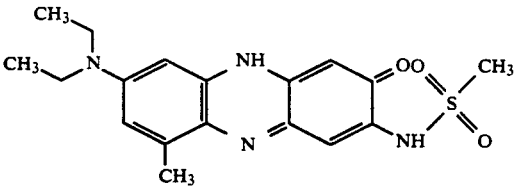
19
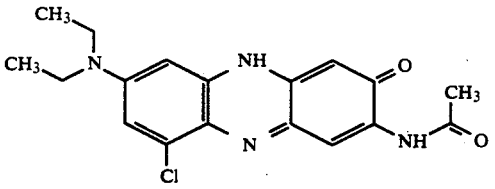
20
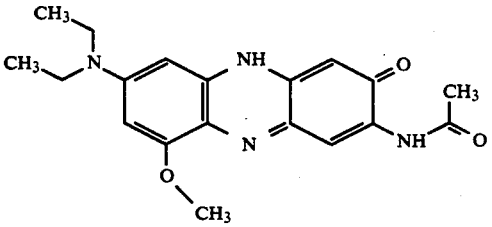
21
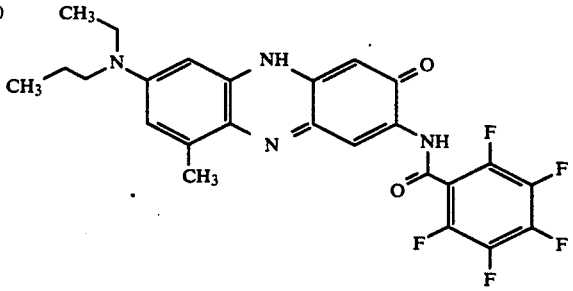
22
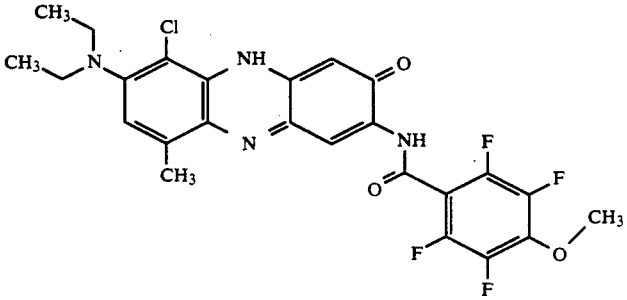

-continued
23
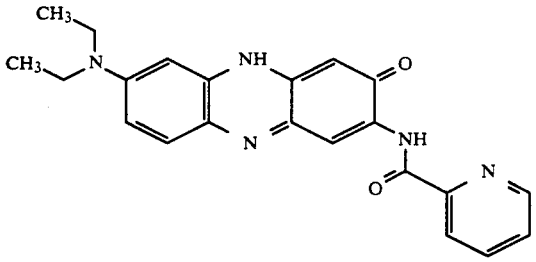
24
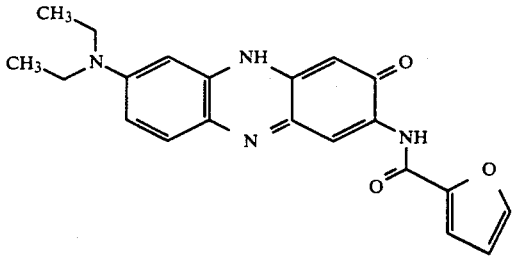
25
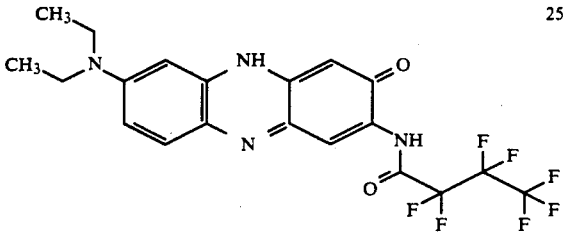
26
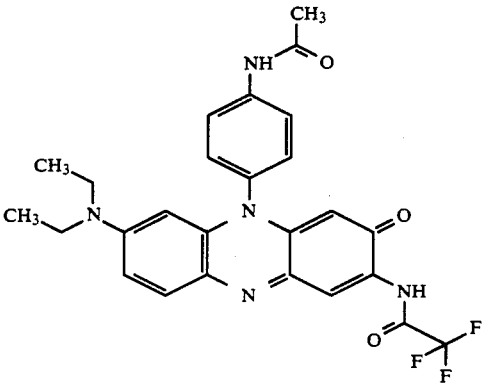
27
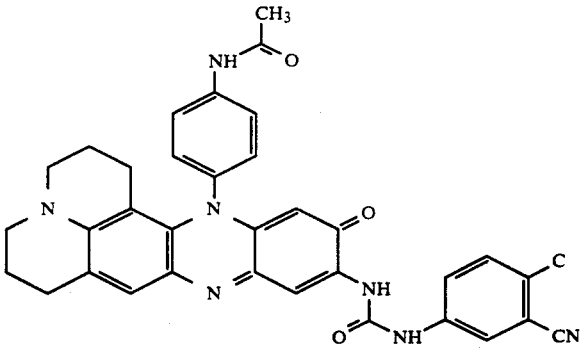
28
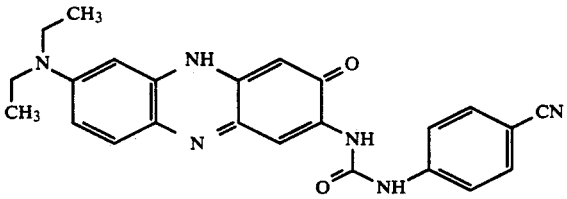
29
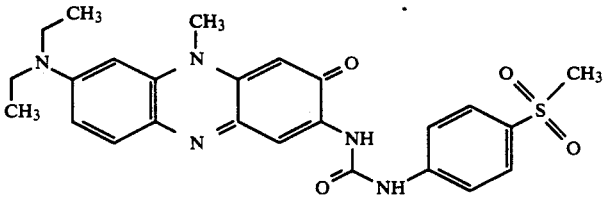
30
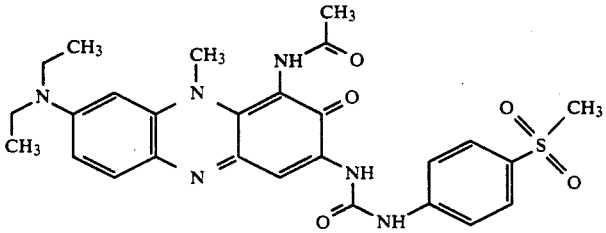

-continued

31

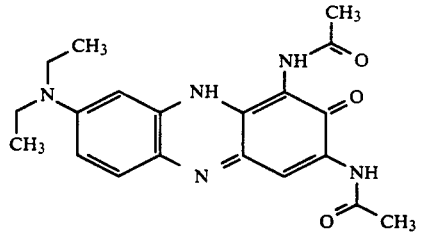

32

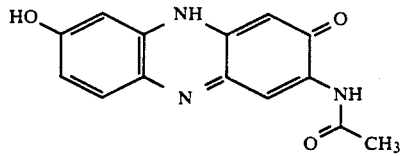

33

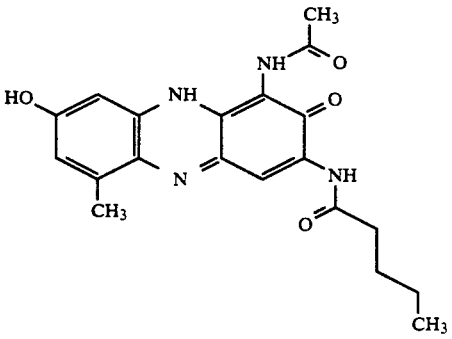

34

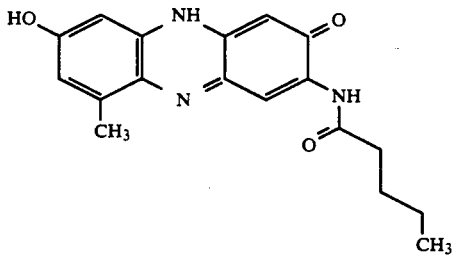

35

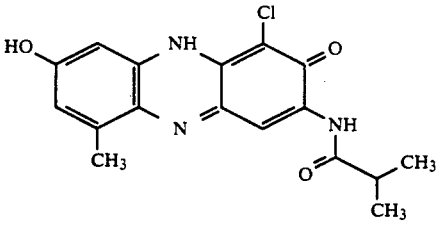

36

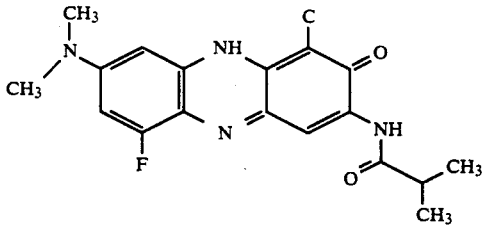

37

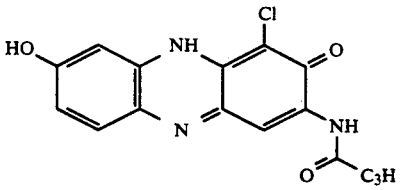

38

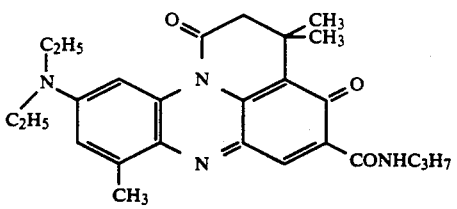

17. The recording material of claim 1 wherein the compound of the formula (I) is present in an amount of 0.2 to 10 g per 1 $m^2$ of the support.

18. The recording material of claim 1 wherein the thickness of the heat-sensitive layer is 0.1 to 5 μm as dry film thickness.

19. The recording material of claim 18 wherein the thickness of the heat-sensitive layer is 0.2 to 3 μm as dry film thickness.

20. The recording material of claim 1 wherein the support is at least one selected from the group consisting of a condenser paper, a glassine paper, polyethylene terephthalate, polyamide and polycarbonate.

21. The recording material of claim 1 wherein the thickness of the support is 2 to 30 μm.

22. The recording material of claim 21 wherein the thickness of the support is 3 to 20 μm.

* * * * *